US006502666B2

(12) United States Patent
Takada et al.

(10) Patent No.: US 6,502,666 B2
(45) Date of Patent: Jan. 7, 2003

(54) ENGINE LUBRICATION SYSTEM

(75) Inventors: Hideaki Takada, Wako (JP); Nobuo Suzuki, Wako (JP); Hiroyuki Yoshida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 82 days.

(21) Appl. No.: 09/816,780

(22) Filed: Mar. 26, 2001

(65) Prior Publication Data

US 2002/0000344 A1 Jan. 3, 2002

(30) Foreign Application Priority Data

Mar. 31, 2000 (JP) ..... 2000-101143
Jun. 6, 2000 (JP) ..... 2000-168739

(51) Int. Cl.[7] ..... F01M 11/00

(52) U.S. Cl. ..... 184/6.28; 184/27.1; 440/88; 123/196 W

(58) Field of Search ..... 184/6.28, 6.5, 184/27.1, 104.3; 123/195 P, 196 W, 198 C; 440/88

(56) References Cited

U.S. PATENT DOCUMENTS 4,452,194 A * 6/1984 Watanabe ..... 123/195 P
6,041,892 A * 3/2000 Watanabe et al. ..... 184/6.28
6,367,442 B1 * 4/2002 Takayanagi ..... 123/196 W
6,371,246 B1 * 4/2002 Watanabe et al. ..... 184/6.28
6,418,887 B1 * 7/2002 Okamoto ..... 123/41.33

FOREIGN PATENT DOCUMENTS

JP 64-25415 2/1989
JP 1-267307 10/1989

* cited by examiner

*Primary Examiner*—Christopher P. Schwartz
(74) *Attorney, Agent, or Firm*—Arent Fox Kintner Plotkin & Kahn, PLLC

(57) ABSTRACT

An engine lubrication system is provided which has an oil pump for supplying lubricating oil from an oil pan to an area that is to be lubricated, the oil pump being positioned outside-the-oil pan and driven by a camshaft. An oil passage formation member fitted to the lower face of an engine block so as to be housed in the oil pan, comprises an oil inlet passage for taking in oil from the oil pan to the oil pump and a relief valve for discharging excess oil discharged by the oil pump via an oil supply passage. When the relief valve opens, the excess oil is not directly discharged to the oil pan but is returned to the oil inlet passage from the oil supply passage via a connecting path. The space required for housing a vertical engine, and in particular in the vertical direction, can thus be reduced and the formation of bubbles in the oil inside the oil pan due to the oil discharged by the relief valve through the oil supply passage, can be prevented.

3 Claims, 12 Drawing Sheets

FRONT-BACK DIRECTIONS
FRONT
BACK
O
3
3
S
R
E

ENGINE LUBRICATION SYSTEM

BACKGROUND OF THE INVENTION

1. Field of the Invention

The, present invention relates to an engine lubrication system for supplying the oil, inside an oil pan which is joined to the lower part of an engine block, the engine block supporting a crankshaft in the vertical direction, to an area that is to be lubricated by means of an oil pump.

2. Description of the Related Art

Japanese Utility Model Registration Application Laid-open No. 64-25415 discloses a system in which the oil, inside an oil pan joined to the lower face of the engine block of a vertical engine, is drawn off by means of an oil pump provided on the lower end of a camshaft and supplied to each area that is to be lubricated via an oil supply passage. The oil supply passage is provided with a relief valve, and when the pressure of-the oil discharged by the oil pump becomes excessive, the relief valve opens to return-the oil in the oil supply passage, to the oil pan.

Furthermore, Japanese Patent Application Laid-open No. 1-267307 discloses a system in which an oil pan is joined to the lower face of the engine block of a vertical engine via a bearing case, and an oil pump is provided on the bearing case.

With regard to the above-mentioned system disclosed by Japanese Utility Model Registration Application Laid-open No. 64-25415, since the excess oil is directly discharged into the upper space of the oil pan via the oil supply passage when the relief valve opens, the oil dropping down from the relief valve above, makes the oil inside the oil pan foam, and there is a possibility that the oil that is drawn off from the oil pan via the oil pump could thereby be contaminated with air bubbles, thus degrading the lubrication performance.

With regard to the above-mentioned system disclosed by Japanese Patent Application Laid-open No. 1-267307, since the oil pump is placed between the engine block and the oil pan, in order to secure a space for placing the oil pump that is sufficient for the external size of the pump, it is necessary to provide space between the engine and the surrounding structure in the horizontal direction and, in particular, in the vertical direction, and there is the problem that the size of engine compartment increases.

SUMMARY OF THE INVENTION

The present invention has been carried out in view of the above-mentioned circumstances, and it is an object of the present invention to reduce the space required for a vertical engine, particularly in the vertical direction, and to prevent bubble formation in the oil inside the oil pan due to the oil discharged by the relief valve via the oil supply passage.

In accordance with a first characteristic of the present invention in order to achieve the above-mentioned object, there is proposed an engine lubrication system comprising an oil pan joined to the lower part of an engine block, the engine block supporting a crankshaft in the vertical direction. An oil pump draws off oil, stored in the oil pan via an oil inlet passage and supplies the oil to an area that is to be lubricated via an oil supply passage. A relief valve is provided for discharging excess oil discharged from the oil pump via the oil supply passage. The oil pump is placed outside the oil pan and is driven by a camshaft, and the relief valve is placed inside the oil pan. The oil supply passage and oil inlet passage are communicated with each other via a connecting path by opening the relief valve.

In accordance with the above-mentioned arrangement, since the oil pump is placed outside the oil pan and driven by the camshaft and the relief valve is separated from the oil pan and placed inside the oil pan, the space needed for placing the oil pump and the relief valve can be divided into two spaces. By so doing, the space needed for the engine particularly in the vertical direction can be reduced in comparison with the case where a large-sized oil pump including an integral relief valve is driven by a camshaft or crankshaft and, in particular, with regard to the engine for an outboard motor which is mounted on a supporting face close to the bottom of the engine compartment, the size of the engine compartment can be reduced. Furthermore, when the relief valve provided in the oil supply passage for supplying oil from the oil pump to an area that is to be lubricated, opens, since the oil passing through the relief valve from the oil supply passage is not returned directly to the oil pan but it is returned to the oil inlet passage extending from the oil pan to the oil pump via the connecting path, it is possible to prevent bubble formation in the oil inside the oil pan due to the oil discharged from the relief valve. It is thus possible to prevent bubble contamination of the oil drawn off from the oil pan by the oil pump and to reliably lubricate an area that is to be lubricated.

In accordance with a second characteristic of the present invention, in addition to the above-mentioned first characteristic, an engine lubrication system is proposed, wherein an oil passage formation member, to which a suction pipe extending inside the oil pan, drawing off oil, and supplies the oil to the oil pump is connected, is fixed in a detachable manner to the lower face of the engine block. The oil inlet passage, the relief valve and the connecting path are provided in the oil passage formation member.

In accordance with the above-mentioned arrangement, since the oil inlet passage, the relief valve and the connecting path are provided in the oil passage formation member that is fixed in a detachable manner to the lower face of the engine block, and the suction pipe is connected to the oil passage member, the suction pipe and the relief valve can be assembled merely by fixing the oil passage formation member to the lower face of the engine block without subjecting the engine block to any special processing, thus contributing to a reduction in the number of assembly steps. Moreover, by forming the oil inlet passage, relief valve and connecting path into an assembly that also provides a connection part for the suction pipe, the number of parts and the cost can be reduced.

Oil passage $p_0$ and oil chamber $r_1$ in the embodiment below correspond to the oil inlet passage and oil supply passage respectively of the present invention.

BRIEF DESCRIPTION OF THE DRAWINGS

FIG. 1 is a side view of a complete outboard motor of the present invention.

FIG. 2 is a magnified view of an essential part of FIG. 1.

FIG. 3 is a cross-sectional view at line 3—3 in FIG. 2.

FIG. 4 is a magnified view of an essential part of FIG. 2.

FIG. 5 is a cross-sectional view at line 5—5 in FIG. 4.

FIG. 6 is a view from arrow 6 in FIG. 5.

FIG. 7 is a view from arrow 7 in FIG. 6.

FIG. 8 is a cross-sectional view at line 8—8 in FIG. 4.

FIG. 9 is a view from arrow 9 in FIG. 4.

FIG. 10 is a cross-sectional view at line 10—10 in FIG. 4.

FIG. 11 is a cross-sectional view at line 11—11 in FIG. 10.

FIG. 12 is a cross-sectional view at line 12—12 in FIG. 11.

DESCRIPTION OF PREFERRED EMBODIMENTS

The practical features of the present invention are explained below by reference to the embodiment of the present invention shown in the attached drawings.

Figure 1:
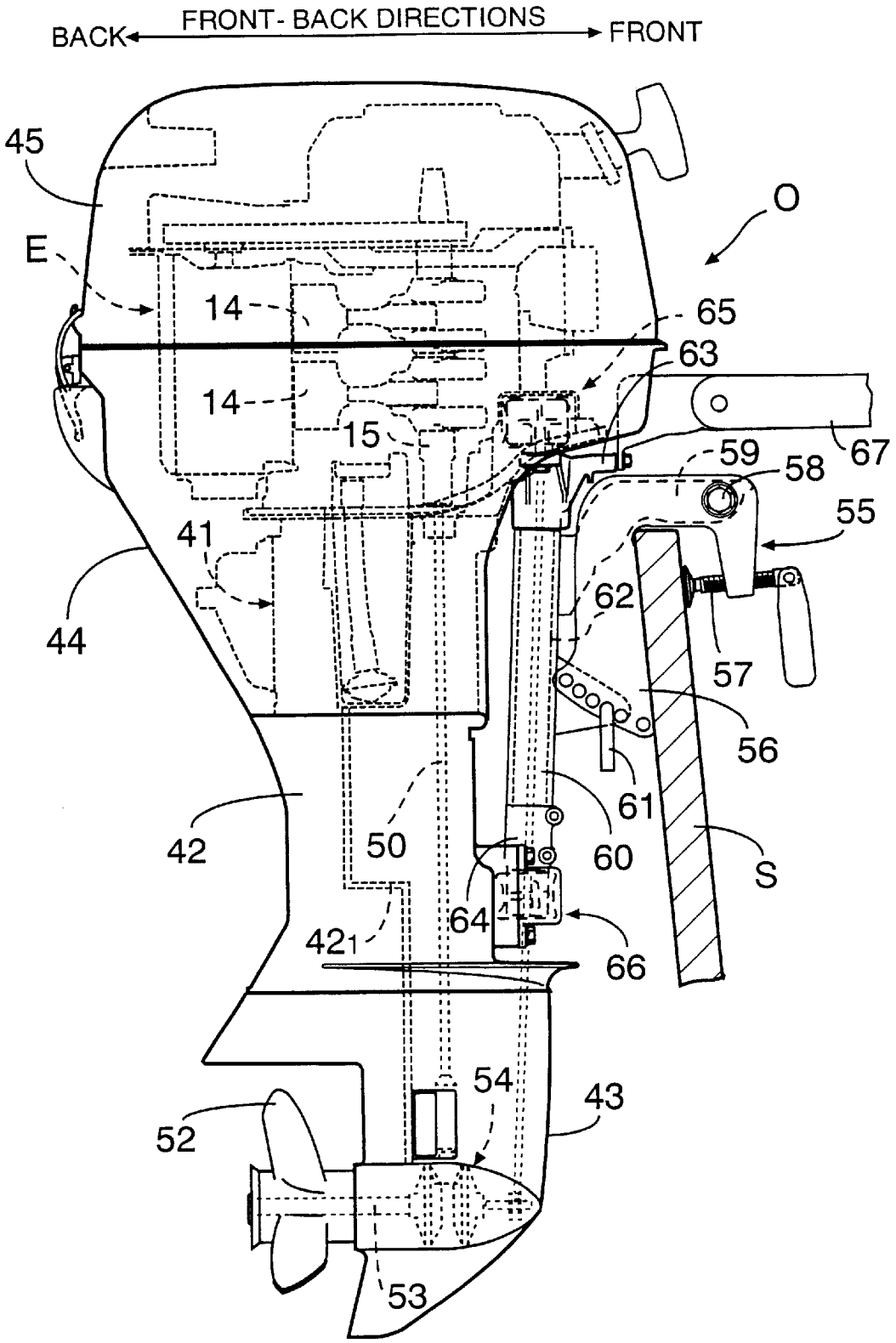
FIG. 1 to FIG. 12 illustrate one embodiment of the present invention.
Figure 2:
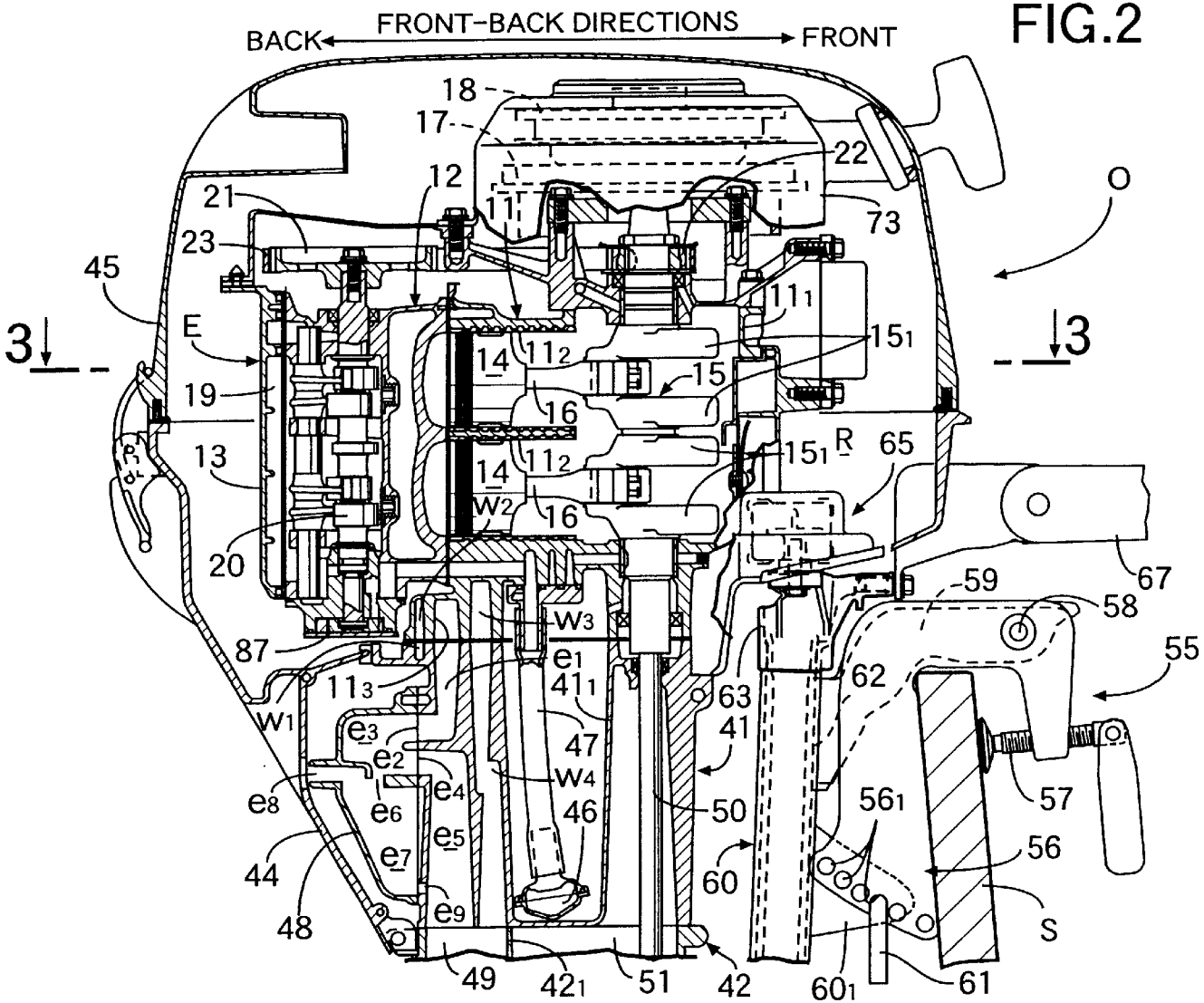
Figure 3:
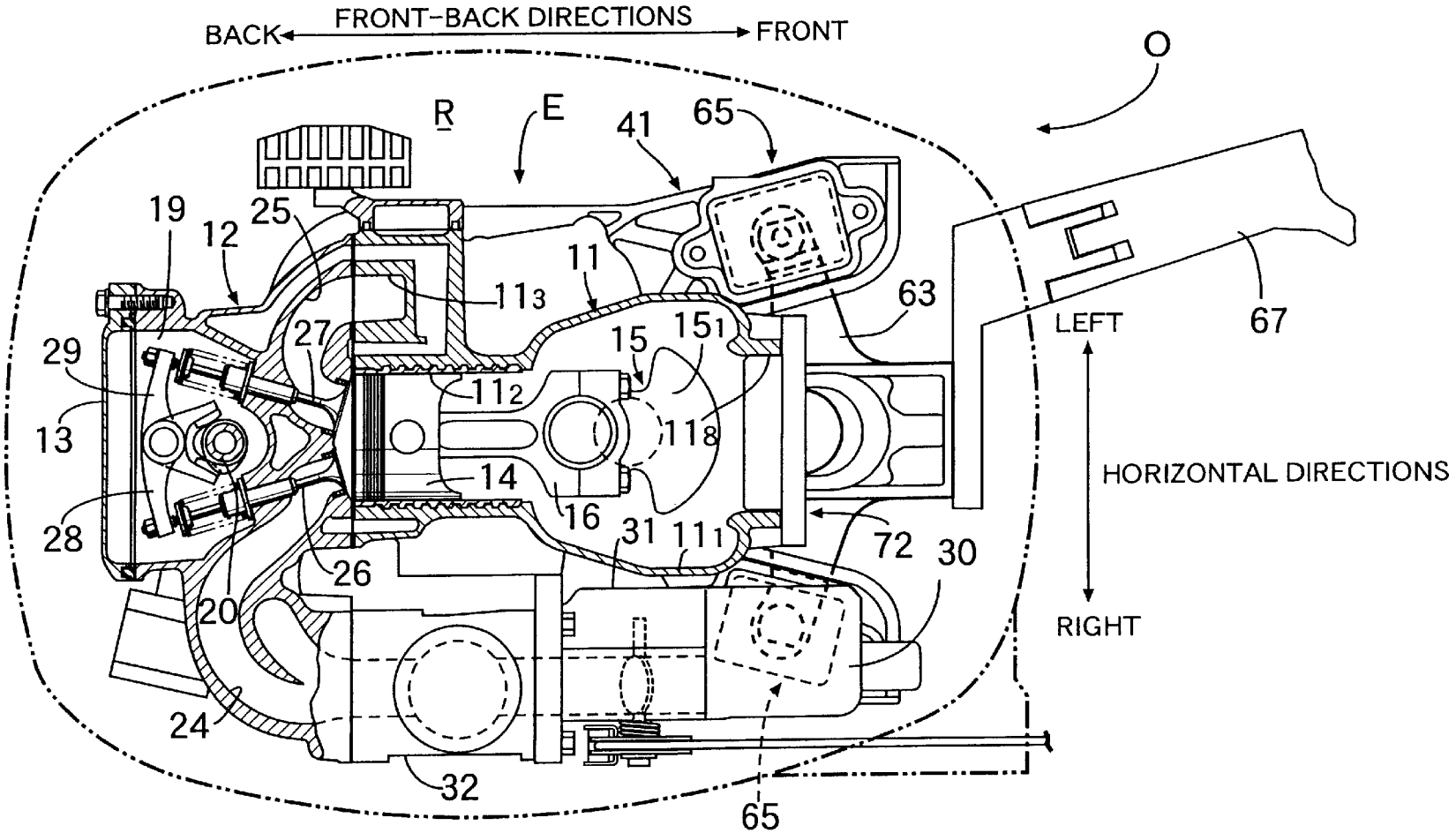

FIGS. 1 to 12 illustrate the preferred embodiment of the present invention. As shown in FIGS. 1 to 3, a two-cylinder four cycle engine E mounted on the upper part of an outboard motor O, comprises an engine block 11 integrally comprising a crank case $\mathbf{11}_1$ and two cylinder bores, i.e. upper and lower cylinder bores $\mathbf{11}_2$ and $\mathbf{11}_2$, a cylinder head 12 joined to the engine block 11, a head cover 13 joined to the cylinder head 12, and two pistons 14 and 14 fitted in a slidable manner inside the two cylinder bores $\mathbf{11}_2$ and $\mathbf{11}_2$ formed in the engine block 11. The pistons 14 and 14 are linked to a crankshaft 15 which is supported on the engine block 11 via connecting rods 16 and 16.

A power generator 17 and a recoil starter 18 are provided coaxially on a shaft end of the crankshaft 15, which projects upwards from the engine block 11. A camshaft 20 is supported in a valve operation chamber 19 which is formed between the cylinder head 12 and the head cover 13, and a cam pulley 21 provided on the upper end of the camshaft 20 is connected to a crank pulley 22 provided on the upper part of the crankshaft 15 via a timing belt 23. An intake valve 26 and an exhaust valve 27 for opening and closing an intake port 24 and an exhaust port 25 respectively formed in the cylinder head 12, are connected to the camshaft 20 via an intake rocker arm 28 and an exhaust rocker arm 29 respectively. An air cleaner 30, a throttle valve 31 and a carburetor 32 which are placed on the right-hand face of the engine E, are connected to the intake port 24.

The axis of the crankshaft 15 is arranged vertically, and the axes of the cylinder bores $\mathbf{11}_2$ and $\mathbf{11}_2$ are arranged horizontally so that the crank case 11 side faces forwards and the cylinder head 12 side faces backwards. The crank phases of the two pistons 14 and 14 are synchronized and the ignition timing is separated by 360°. The crankshaft 15 is provided with counter weight $\mathbf{15}_1$ having a balance ratio of 100%, that counteract the reciprocating mass of the pistons 14 and 14.

The upper face of an oil case 41 which is an oil pan component member, is joined to the lower face of the engine E of the above structure, the upper face of an extension case 42 is joined to the lower face of the oil case 41, and the upper face of a gear case 43 is joined to the lower face of the extension case 42. The outer periphery of the oil case 41 and the outer periphery of the lower half of the engine E are covered by an under cover 44 joined to the upper end of the extension case 42, and the upper half of the engine E is covered by an engine cover 45 joined to the upper end of the under cover 44. That is to say, an engine compartment R (see FIGS. 2 and 3) housing the engine E, is formed by the engine cover 45 and the upper half of the under cover 44 that is positioned above an oil case attachment face $\mathbf{11}_5$ formed on the lower end of the engine block 11. The oil case attachment face $\mathbf{11}_5$ of the engine block 11 forms an engine attachment support face through which the engine E is mounted to the extension case 42 via the oil case 41.

As is clear from FIG. 2, the oil case 41 comprises an integral oil pan $\mathbf{41}_1$, and a suction pipe 47 having an oil strainer 46 is housed inside the oil pan $\mathbf{41}_1$. An exhaust passage formation member 48 is connected to the rear face of the oil case 41, and an exhaust expansion chamber 49 is defined inside the extension case 42 via a partition $\mathbf{42}_1$.

Exhaust gas discharged from the exhaust port 25 flows from a main exhaust passage $\mathbf{11}_3$ formed inside the engine block 11 into a first main exhaust passage $e_1$ formed in the oil case 41 (see arrows a in FIG. 10), and further into an upper exhaust expansion chamber $e_3$ formed on the upper part of the exhaust passage formation member 48 through a connecting hole $e_2$. A portion of the exhaust gas inside the upper exhaust expansion chamber $e_3$ flows into a second main exhaust passage $e_5$ formed in the oil case 41 through a connecting hole $e_4$ and is discharged therefrom into the water outside via the exhaust expansion chamber 49 of the extension case 42, the inside of the gear case 43 and a cavity around a propeller shaft 53. Another portion of the exhaust gas inside the upper exhaust expansion chamber $e_3$ of the exhaust passage formation member 48 flows into a lower exhaust expansion chamber $e_7$ formed in the lower part of the exhaust passage formation member 48 through al connecting hole $e_6$ and is discharged therefrom into the air via an exhaust outlet $e_8$. A water drain hole $e_9$ is formed in the lower end of the lower exhaust expansion chamber $e_7$ for discharging the water accumulated therein via the main exhaust passage $e_5$ of the oil case 41.

Figure 10:
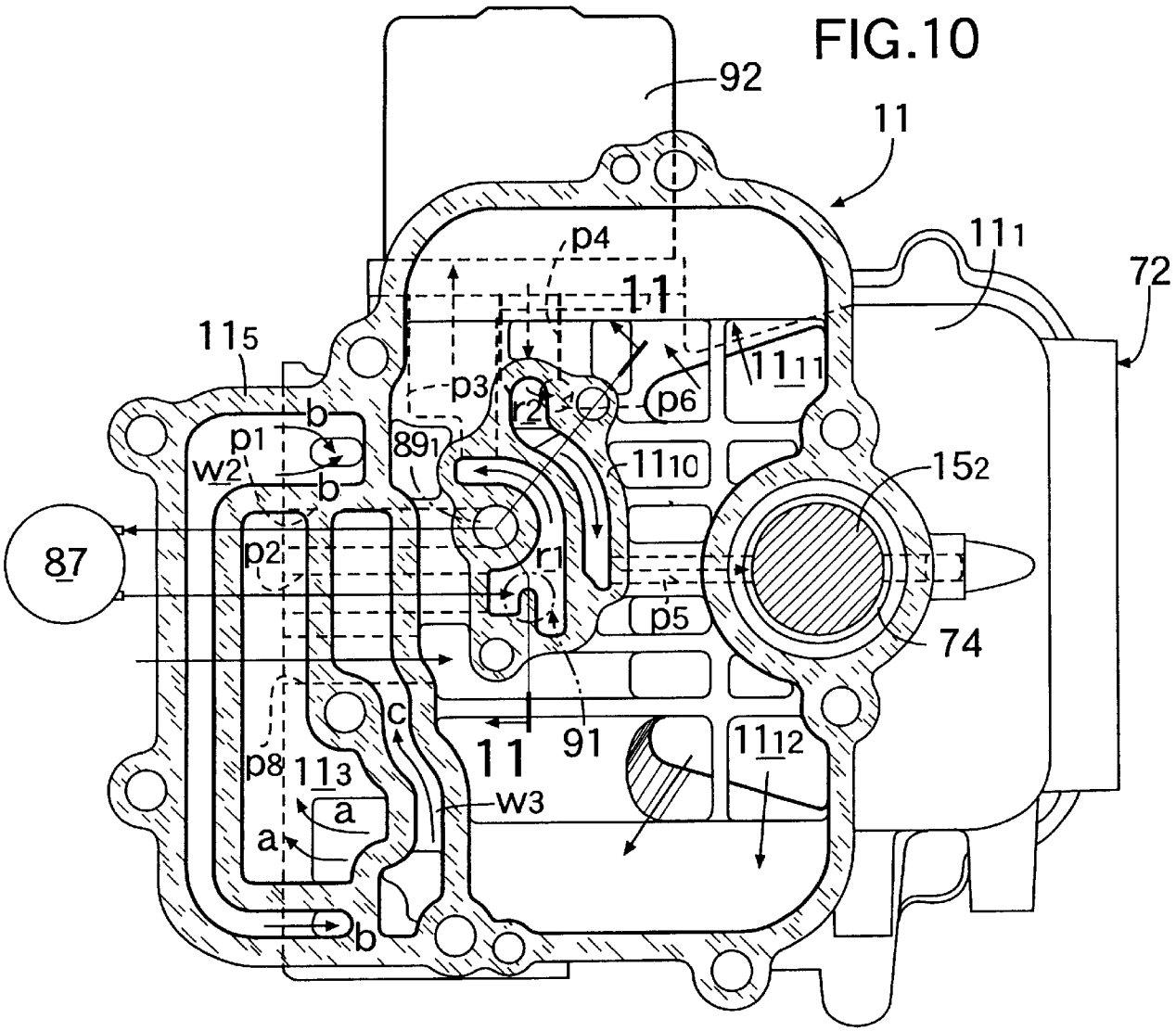

As is clear from FIGS. 2 and 10, cooling water drawn off by a cooling water pump (not illustrated) is supplied to cooling water passages $w_1$ and $w_2$ formed at the interface where the engine block 11 and the oil case 41 are joined to each other, and the supply is there divided between the engine block 11 and the cylinder head 12 (see arrows b in FIG. 10). After cooling the engine block 11 and cylinder head 12, the cooling water is supplied to a cooling water passage $w_3$ formed in the lower face of the engine block 11 (see arrow c in FIG. 10) and discharged therefrom into the extension case 42 via a cooling water passage $w_4$ formed in the oil case 41.

A drive shaft 50 connected to the lower end of the crankshaft 15 runs through the oil case 41, extends downwards inside a drive shaft chamber 51 formed in the extension case 42, and is connected, via a forward/reverse switch mechanism 54, to the forward end of the propeller shaft 53 comprising a propeller 52 at its rear end and being supported in the gear case 43 in the front-back directions.

A mounting bracket 55 for mounting the outboard motor O to a boat body S in a detachable manner comprises an inverted-J shaped mounting bracket main body 56 and a clamping screw 57 which is screwed into the mounting bracket main body 56. The forward end of a pivot arm 59 is pivotally supported on the mounting bracket main body 56 via a fulcrum pin 58, and a tube-shaped swivel case 60 is integrally bonded to the rear end of the pivot arm 59. The mounting bracket main body 56 is provided with a large number of pin holes $\mathbf{56}_1$, and by inserting a pin 61 into both a pin hole formed on an engagement board $\mathbf{60}_1$ fixed to the swivel case 60, and into any one of the pin holes $\mathbf{56}_1$ of the mounting bracket main body 56, the tilt angle of the outboard motor O around the fulcrum pin 58 can be adjusted.

A swivel shaft 62 fitted inside the swivel case 60 in a relatively rotatable manner, comprises a mounting arm 63 and a mounting block 64 on the upper and lower ends respectively thereof. The mounting arm 63 on the upper side is elastically connected to the oil case 41 via a pair of right and left upper mounts 65 and 65, and the mounting block 64 on the lower side is elastically connected to the extension case 42 via a lower mount 66. A steering handle 67 is fixed to the forward end of the oil case 41, and the outboard motor O can be steered by gripping the steering handle 67 and operating it rightwards and leftwards so as to move the oil case 41 rightwards and leftwards around the swivel shaft 62.

The structure by which the crankshaft 15 is supported in the engine block 11, is explained below by reference to FIGS. 4 to 7 and 9.

The engine block 11 integrally comprising the crank case $\mathbf{11}_1$ and forming the two cylinder bores $\mathbf{11}_2$ and $\mathbf{11}_2$ further comprises, on its rear face, a cylinder head joining face $\mathbf{11}_4$ to which the cylinder head 12 is joined; on its lower face, an oil case joining face $\mathbf{11}_5$ to which the oil case 41 is joined; on its upper face, an upper cover joining face $\mathbf{11}_6$ to which an upper cover 71 is joined and; on its front face, a breather device joining face $\mathbf{11}_7$ to which a breather device 72 is joined for returning blowby gas inside the crank case $\mathbf{11}_1$ into the intake system. The breather device joining face $\mathbf{11}_7$ is formed on the base of the crank case $\mathbf{11}_1$ of the engine block 11, and an opening $\mathbf{11}_8$ is formed in the centre of the breather device joining face $\mathbf{11}_7$ so as to be communicated with the internal space of the crank case $\mathbf{11}_1$ (see FIG. 7).

Figure 4:
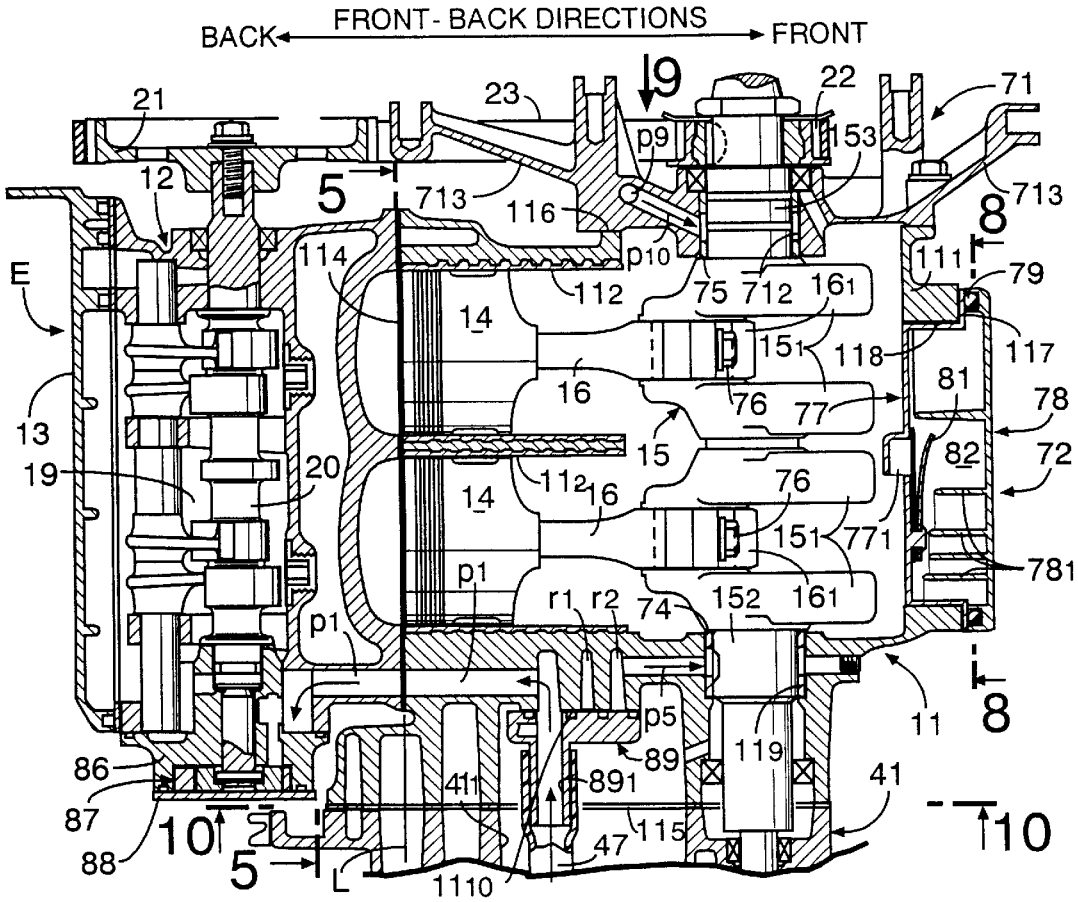
Figure 9:
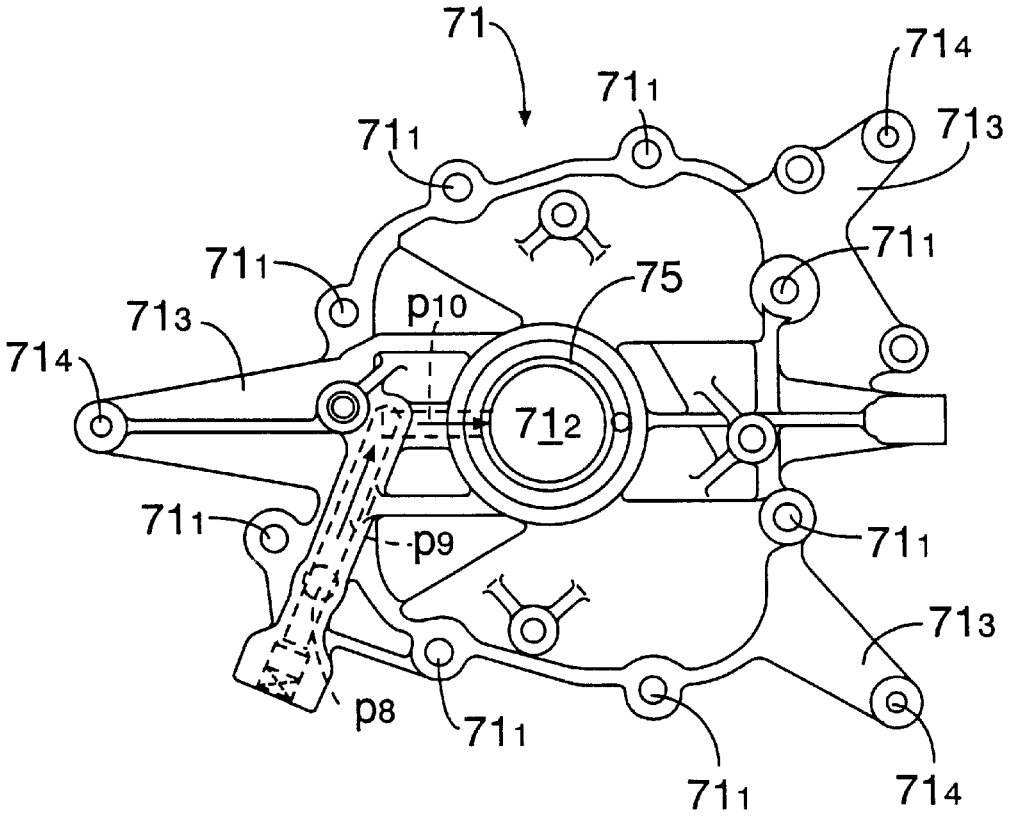

As is clear from FIGS. 4 and 9, the upper cover 71 is joined to the upper cover joining face $\mathbf{11}_6$ which is the upper face of the engine block 11 and tightened to the engine block 11 via bolts running through eight bolt holes $\mathbf{71}_1$. Three arms $\mathbf{71}_3$ extend radially outwards from a bearing hole $\mathbf{71}_2$ formed in the center of the upper cover 71, and a starter cover 73 covering the power generator 17 and the recoil starter 18, is fixed to the bolt holes $\mathbf{71}_4$ formed on the outer ends of the arms $\mathbf{71}_3$ (see FIG. 2).

Figure 7:
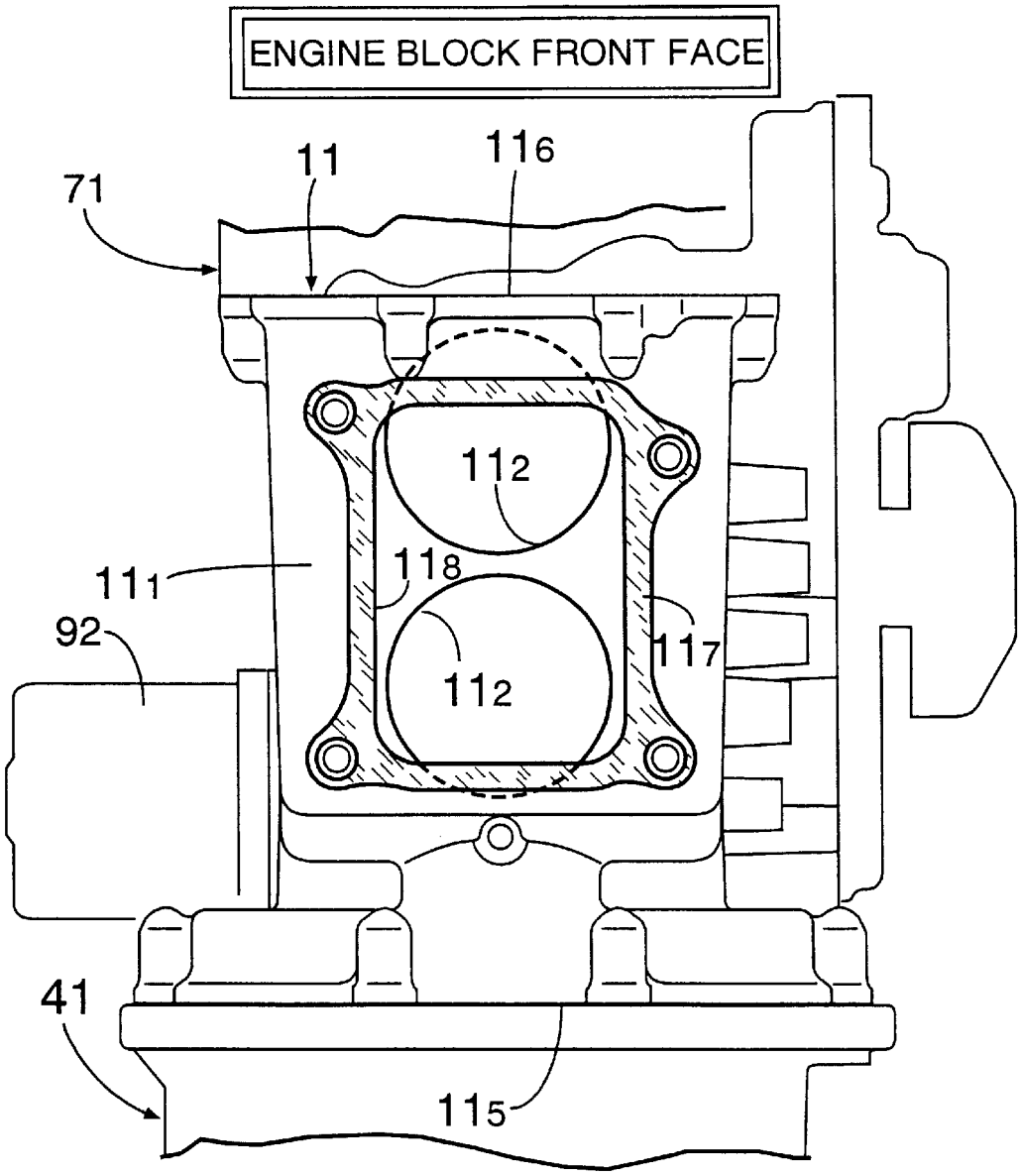

A journal $\mathbf{15}_2$ on the lower side of the vertically arranged crankshaft 15, is supported in a metal bearing 74 fixed to the inside of a bearing hole $\mathbf{11}_9$ in the lower wall of the engine block 11, and a journal 153 on the upper side of the crankshaft 15 is supported in a metal bearing 75 fixed to the inside of a bearing hole $\mathbf{71}_2$ of the upper cover 71 (see. FIG. 4). While the journal $\mathbf{15}_2$ on the lower side of the crankshaft 15 and the journal $\mathbf{15}_3$ on the upper side thereof are supported in the engine block 11 and the upper cover 71, bearing caps $\mathbf{16}_1$ and $\mathbf{16}_1$ attached to the large ends of the upper and lower connecting rods 16 and 16 via bolts 76 face the opening $\mathbf{11}_5$ formed on the crank case $\mathbf{11}_1$ which is integral with the engine block 11 (see. FIGS. 4 and 7).

As mentioned above, the two cylinder bores $\mathbf{11}_2$ and $\mathbf{11}_2$ and the bearing hole $\mathbf{11}_9$ supporting the journal $\mathbf{15}_2$ on the lower side of the crankshaft 15 are formed in the engine block 11 integrally comprising the crank case $\mathbf{11}_1$, and the cylinder bores $\mathbf{11}_2$ and $\mathbf{11}_2$ and bearing hole $\mathbf{11}_9$, are formed in the engine block 11 alone, which is a single member, without extending over two members. It is therefore unnecessary to carry out co-processing, in which the part where two members are joined together is subjected to processing while they are joined together, when processing the cylinder bores $\mathbf{11}_2$ and $\mathbf{11}_2$ and bearing hole $\mathbf{11}_9$, and not only can the number of steps required for bonding and separating these members be reduced, but also the processing precision can be enhanced. Similarly, the bearing hole $\mathbf{71}_2$ supporting the journal $\mathbf{15}_3$ on the upper side of the crankshaft 15, is formed in the upper cover 71 which is a single member, and co-processing is unnecessary for processing the bearing hole $\mathbf{71}_2$ thus reducing the number of processing steps and enhancing the processing precision. Moreover, since the engine block 11 and the upper cover 71 do not need to be replaced as a set but can be replaced individually, the replaceability of parts can thus be enhanced.

The assembly around the crankshaft 15 of the engine E can be carried out by the following procedure. In a state in which the journal $\mathbf{15}_2$ on the lower side of the crankshaft 15 is supported in the bearing hole $\mathbf{11}_9$ of the engine block 11, the upper cover 71 is joined to the upper cover joining face $\mathbf{11}_6$ of the engine block 11, while fitting the journal $\mathbf{15}_3$ on the upper side of the crankshaft 15 in the bearing hole $\mathbf{71}_2$ of the upper cover 71. Subsequently, the pistons 14 and 14 pre-connected to the connecting rods 16 and 16, are fitted inside the cylinder bores $\mathbf{11}_2$ and $\mathbf{11}_2$ from the side of the cylinder head joining face $\mathbf{11}_4$, and the bearing caps $\mathbf{16}_1$ and $\mathbf{16}_1$ are tightened by means of the bolts 76 while engaging the large ends of the connecting rods 16 and 16 with the pins of the crankshaft 15.

In this stage, as is clear from FIGS. 4 and 7, since the large ends of the connecting rods 16 and 16 face the opening $\mathbf{11}_8$ on the front face of the engine block 11, the operation of tightening the bearing caps $\mathbf{16}_1$ and $\mathbf{16}_1$ can be carried out easily through the opening 118. It is therefore unnecessary to secure extra space inside the crankcase $\mathbf{11}_1$ in order to carry out the operation of tightening the bearing caps $\mathbf{16}_1$ and $\mathbf{16}_1$ and it is possible to assemble the crankshaft 15, while reducing the size of the engine block 11.

Figure 6:
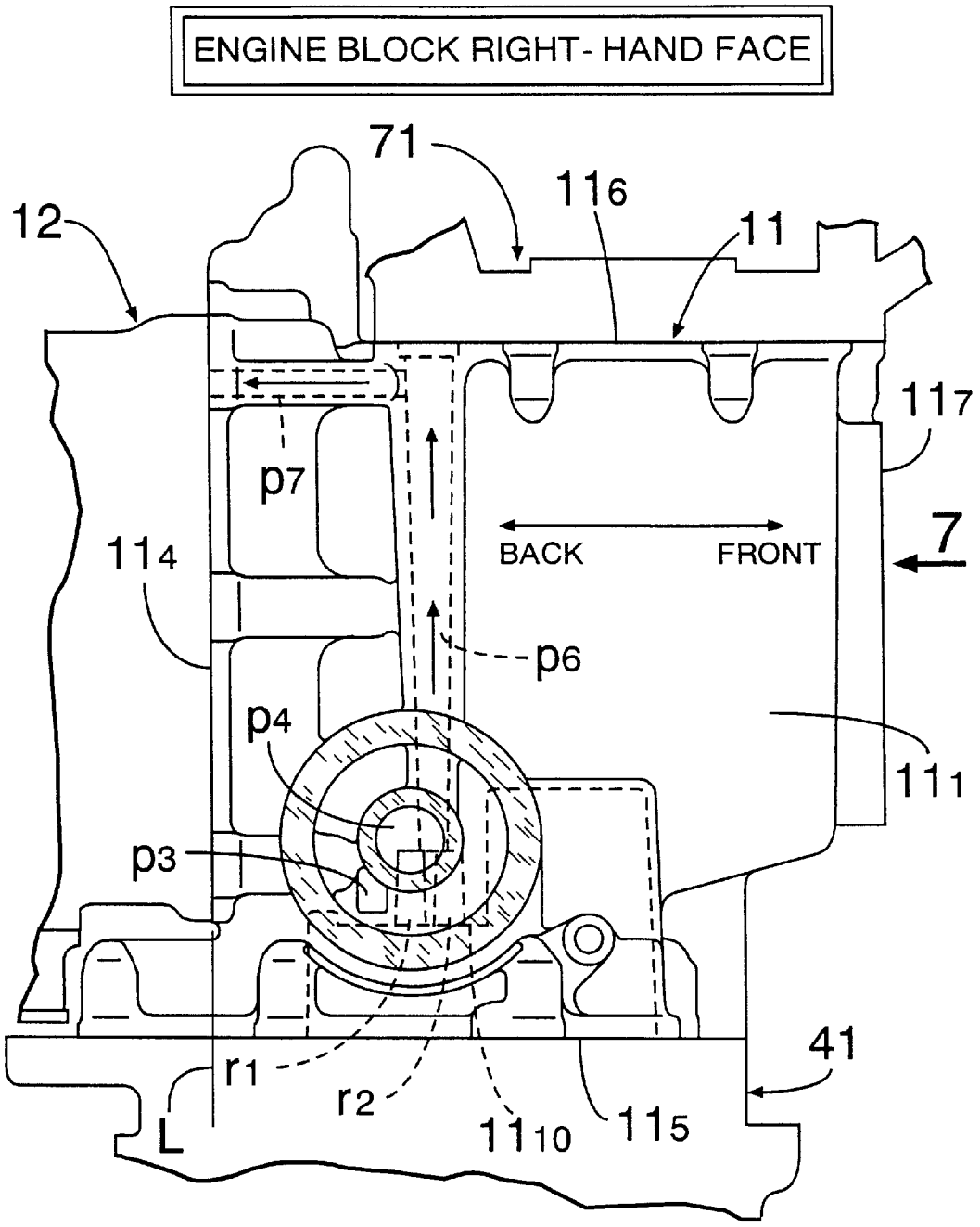

As is clear from FIGS. 4 and 6, by arranging the lower rear part of the engine block 11 to overhang backwards, the horizontal oil case joining face $\mathbf{11}_5$ for joining the oil case 41 to the engine block 11, extends further backwards relative to a line L extending downwards from the vertical cylinder head joining face $\mathbf{11}_4$ for joining the cylinder head 12 to the engine block 11. The area of the oil case joining face $\mathbf{11}_5$ can thus be maximized and an adequate capacity for the oil pan 411 of the oil case 41 joined thereto, can be secured. Since the oil case joining face $\mathbf{11}_5$ and the cylinder head joining face $\mathbf{11}_4$ are not continuous from one to the other, there is no possibility of any problem being caused in the sealing of either the oil case joining face $\mathbf{11}_5$ or the cylinder head joining face 114.

The first and second main exhaust passages $e_1$ and $e_5$ and cooling water passages $w_1$ and $w_4$ are formed vertically in the vicinity of the oil pan $\mathbf{41}_1$ of the oil case 41. Since the lower rear part of the engine block 11 is made to overhang backwards, the area of the oil case 41 that is joined to the oil case joining face $\mathbf{11}_5$ of the engine block 11 also increases, and it is possible to position the first and second main exhaust passages $e_1$ and $e_5$ and cooling water passages $w_1$ and $W_4$ so as not to interfere with the opening of the oil pan $\mathbf{41}_1$. As a result, the opening area of the oil pan $\mathbf{41}_1$ can be increased to thereby increase the capacity.

Figure 8:
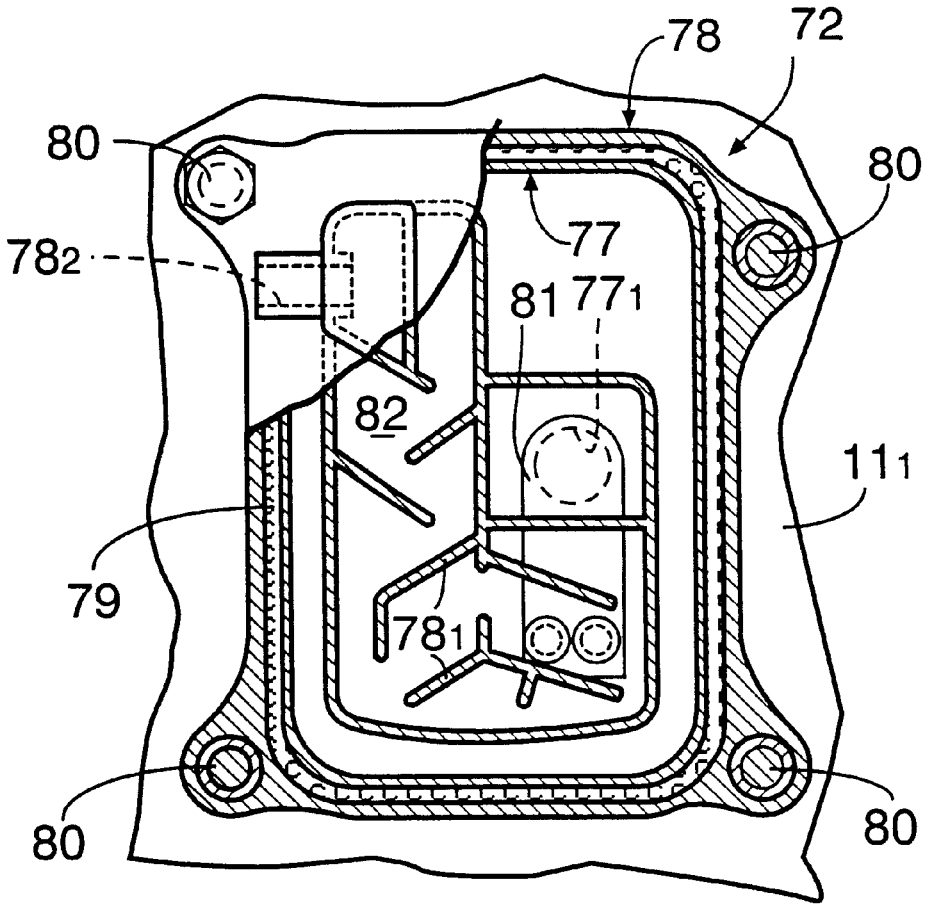

As is clear from FIGS. 4 and 8, the breather device 72 that is attached to block the opening $\mathbf{11}_8$ of the engine block 11, is made in the form of a box by joining an inner member 77 and an outer member 78 via a sealing member 79, and is mounted on the engine block 11 by four bolts 80. An opening $\mathbf{77}_1$ is formed in the inner member 77 to communicate with the crank compartment, and a reed valve 81 for opening and closing the opening 77, is provided on the inner face of the inner member 77. A projecting wall 78, is formed on the inner face of the outer member 78 to project towards the inner member 77, and a labyrinth 82 is formed by the projection wall $\mathbf{78}_1$. A connecting hole $\mathbf{78}_2$ is formed in the outer face of the outer member 78, which provides communication between the inner cavity of the labyrinth 82 and the intake system of the engine E via a breather pipe (not illustrated).

The structure of the lubricating system of the engine E is explained below by reference to FIGS. 4 to 6 and 9 to 12.

As is clear from FIG. 4, a pump housing 86 is fixed to the lower face of the cylinder head 12, and the lower part of the camshaft 20 is supported in the pump housing 86. An oil pump 87 that is driven by the lower end of the camshaft 20, is housed between the lower face of the pump housing 86 and a pump cover 88 that is fixed to the lower face.

As is clear from FIGS. 4 and 10 to 12, an oil passage formation member 89 is fixed by means of bolts 90 and 90 to a seating face $\mathbf{11}_{10}$ of the engine block, the seating face $\mathbf{11}_{10}$ being the ceiling of an oil pan $\mathbf{41}_1$ integrally provided in the oil case 41. The oil passage formation member 89 comprises a joint 89, to which the suction pipe 47 housed inside the oil pan $\mathbf{41}_1$, is connected and a relief valve 91 for discharging excess oil discharged from the oil pump 87.

Since the oil pump 87 is placed outside the oil pan $\mathbf{41}_1$ and driven by the lower end of the camshaft 20 and the relief valve 91 is separated from the oil pump 87 and housed inside the oil pan $\mathbf{41}_1$, the size, and in particular the size in the vertical direction of the engine compartment R housing the engine E, can be reduced. This is because if a large-sized oil pump integrally comprising a relief valve, is driven by the lower end of the camshaft 20, the size of the engine compartment R in the vertical direction has to be increased in order to avoid interference between the oil pump and the structure in the vicinity of the lower end of the camshaft 20, and if a large-sized oil pump integrally comprising a relief valve is driven by the lower end of the crankshaft 15, the size of the engine compartment R in the vertical direction has to be increased in order to avoid interference between the oil pump and the structure in the vicinity of the lower end of the crankshaft 15. However, by placing the oil pump 87 and the relief valve 91 in separate positions as in the present invention, it is possible to avoid interference with other parts of the structure by dividing the required space and to thus reduce the size of the engine compartment R as much as possible.

Figure 11:
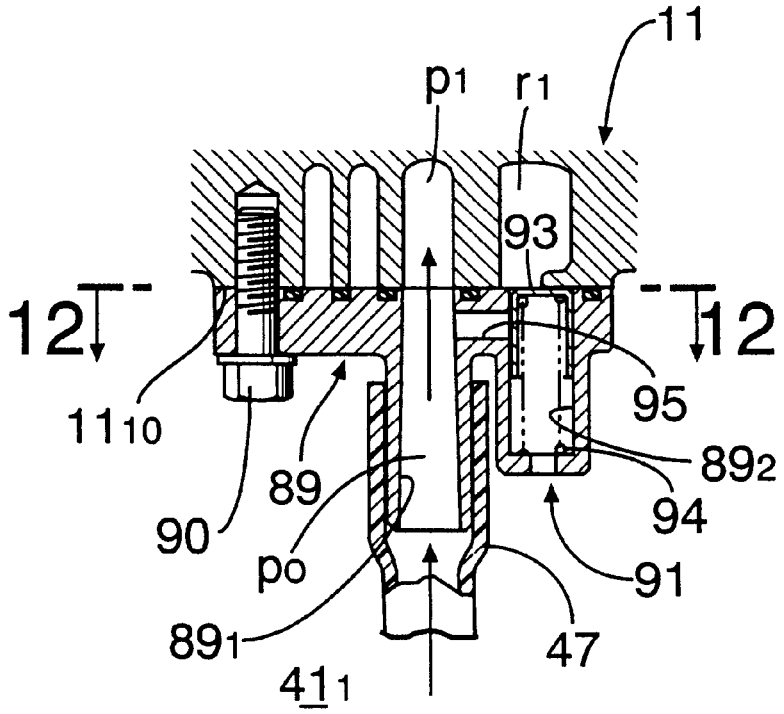
Figure 12:
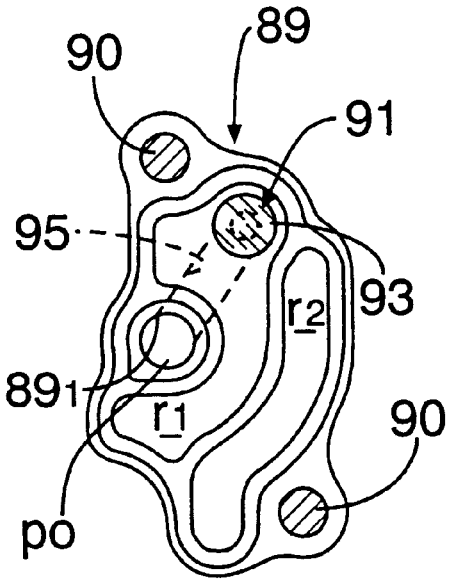

As is shown in FIG. 11 most clearly, the relief valve 91 comprises a valve hole $\mathbf{89}_2$ formed in the vertical direction inside the oil passage formation member 89, and a valve body 93 housed in a vertically slidable manner inside the valve hole $\mathbf{89}_2$, which is forced upwards by means of a valve spring 94. The upper end of the valve hole $\mathbf{89}_2$ is communicated with an oil chamber $r_1$ which will be described below, and the lower end of the valve hole $\mathbf{89}_2$ is communicated with the inner cavity of the oil pan $\mathbf{41}_1$. The upper part of the valve hole $\mathbf{89}_2$ and an oil path $p_0$ formed inside the joint $\mathbf{89}_1$ are communicated with each other via a horizontal connecting path 95. When the relief valve 91 is in the illustrated closed position, the communication between the oil chamber $r_1$ and the oil path $p_0$ is blocked by the valve body 93, and when the valve body 93 descends against the resilient force of the valve spring 94 to open the relief valve 91, the oil chamber $r_1$ is communicated with the oil path $p_0$ via the connecting path 95.

Figure 5:
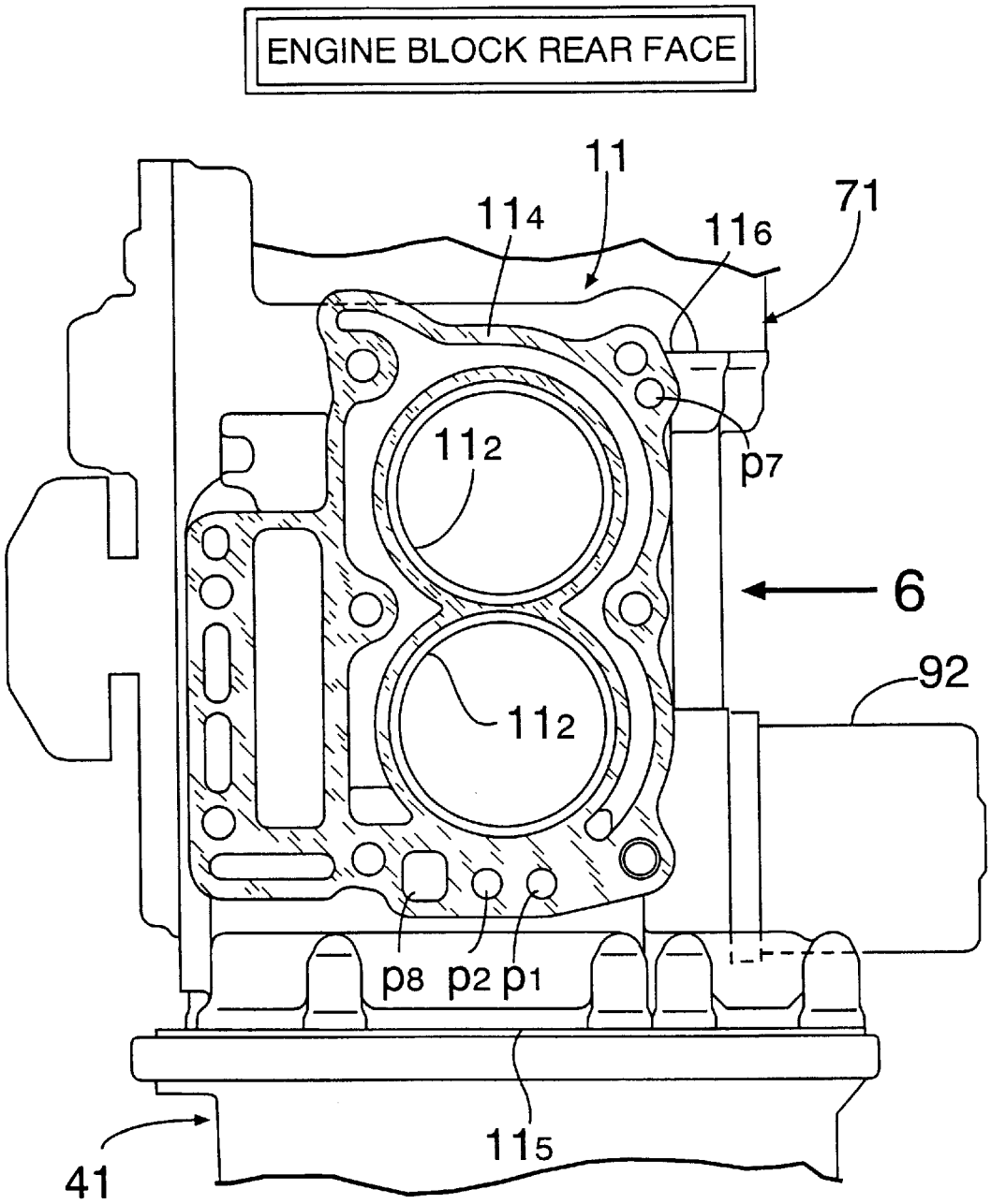

The oil inside the oil pan $\mathbf{41}_1$, is taken into the oil pump 87 via the oil strainer 46, the suction pipe 47, the oil path $p_0$ running vertically through the inside of the joint 89, and the oil path pi running horizontally through the engine block 11 and the cylinder head 12 (see FIGS. 4, 5 and 10). The oil discharged from the oil pump 87 passes through the oil path $p_2$ which is formed parallel to the oil path $p_1$ and runs horizontally through the engine block 11 and the cylinder head 12 (see FIGS. 5 and 10) and is supplied to the oil chamber $r_1$ formed between the engine block 11 and the oil passage formation member 89 (see FIGS. 10 to 12) and therefrom further to an oil filter 92 provided on the right-hand face of the engine block 11 via an oil path $p_3$ formed in the engine block 11 (see FIG. 10). The relief valve 91 faces the oil chamber $r_1$.

The oil path $p_0$ forms the oil inlet passage of the present invention and the oil chamber $r_1$ forms the oil supply passage of the present invention.

The oil filtered through the oil filter 92 is supplied to the oil chamber $r_2$ formed between the engine block 11 and the oil passage formation member 89 (see FIGS. 4 and 10) via an oil path $p_4$ formed in the engine block 11 (FIG. 10) and therefrom further to the metal bearing 74 and the journal $\mathbf{15}_2$ on the lower side of the crankshaft 15 via an oil path $p_5$ formed in the engine block 11 (see FIGS. 4 and 10). The supply of oil to the crank pin on the lower side of the crankshaft 15, is carried out from the lower journal $\mathbf{15}_2$ via an oil path (not illustrated) formed inside the crankshaft 15.

A portion of the oil supplied to the oil chamber $r_2$ is supplied to an oil path $p_6$ running vertically in the engine block 11 (see FIGS. 6 and 10). An oil path $p_7$ which diverges horizontally in the vicinity of the upper end of the oil path $p_6$ (see FIGS. 5 and 6), is communicated with the valve operation chamber 19 through the engine block 11 and the cylinder head 12, to lubricate the valve operation mechanism housed therein. The oil that has lubricated the valve operation mechanism is returned to the oil pan 41, via an oil path $p_8$ running horizontally through the cylinder head 12 and the engine block 11, from the lower end of the valve operation chamber 19 (see FIGS. 5 and 10).

The oil supplied to the oil path $p_6$ running upwards inside the engine block 11 (see FIG. 6) is supplied to the metal bearing 75 and the journal $\mathbf{15}_3$ on the upper side of the crankshaft 15 via oil paths $p_9$ and $p_{10}$ formed in the upper cover 71 (see FIGS. 4 and 9). The supply of oil to the crank pin on the upper side of the crankshaft 15 is carried out from the upper journal $\mathbf{15}_3$ via an oil path (not illustrated) formed inside the crankshaft 15.

Since the oil supply to the journal $\mathbf{15}_3$ on the upper side of the crankshaft 15 which is the furthest from the oil pump 87, is carried out via the oil path $p_6$ formed in the engine block 11 (see FIG. 6) and the oil paths $p_9$ and $p_{10}$ formed in the upper cover 71 without using any oil path formed inside the crankshaft 15, not only can an adequate amount of oil be supplied to the upper journal $\mathbf{15}_3$ to reliably lubricate it, but also the structure of the oil paths can be greatly simplified.

As is clear from FIG. 4, since the oil path $p_{10}$ in the upper cover 71 slopes downwards towards the bearing hole $\mathbf{71}_2$, the oil path $p_{10}$ can be a blind hole that can be provided by drilling from the side of the bearing hole $\mathbf{71}_2$, and it is unnecessary to employ a blind stopper. Thus the number of processing steps and the number of parts can be reduced. If the oil path $p_{10}$ is formed from a through hole that runs through from the external surface of the upper cover 71 to the bearing hole $\mathbf{71}_2$, it is necessary to block the open end on the external surface by means of a blind stopper.

The oil accumulated inside the crank case $\mathbf{11}_1$ from each of the lubricated areas of the engine E is returned to the oil pan $\mathbf{41}_1$ via openings $\mathbf{11}_{11}$ and $\mathbf{11}_{12}$ in the oil case joining face $\mathbf{11}_5$ of the engine block 11 (see FIG. 10).

When the discharge pressure of the oil pump 87 exceeds the valve opening pressure of the relief valve 91, the relief valve 91 opens, the valve body 93 descends, the oil in the oil chamber $r_1$ is returned to the oil path $p_0$ running vertically through the inside of the joint 89, via the connecting path 95, and the oil is again taken into the oil pump 87 from the oil path $p_0$. Since the oil passing through the relief valve 91 is not directly returned to the oil pan 41, from the oil chamber $r_1$ but is taken into the oil pump 87 while bypassing the oil pan $\mathbf{41}_1$, it is therefore possible to prevent bubble formation in the oil inside the oil pan $\mathbf{41}_1$ due to the oil passing through the relief valve 91. As a result, the oil drawn off from the oil pan $\mathbf{41}_1$ by the oil pump 87 can be prevented from being contaminated by air bubbles, and the supply of oil by the oil pump 87 can be carried out reliably, and the lubrication effect can be guaranteed.

Since the suction pipe connected to the oil passage formation member 89 and the relief valve 91 housed inside the oil passage formation member 89, can be assembled merely by fixing the oil passage formation member 89 to the lower face of the engine block 11 without subjecting the engine block 11 to any special processing, the number of assembly steps can be reduced. Moreover, the oil path $p_0$, the connecting path 95 and the relief valve 91 are made into an assembly by integrally providing them in the oil passage formation member 89 that also provides a connection part for the suction pipe, and the number of parts and the cost can thus be reduced.

The above embodiment illustrates the vertical engine E of an outboard motor O, but the present invention can be applied to a vertical engine for any application.

The present invention may be embodied in the other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An engine lubrication system for an engine including an engine block, a crankshaft and a cam shaft, the lubrication system comprising:

an oil pan joined to the lower part of the engine block, the engine block supporting the crankshaft in the vertical direction;

an oil inlet passage;

an oil supply passage;

an oil pump for drawing off oil stored in the oil pan through the oil inlet passage and supplying the oil to an area to be lubricated through the oil supply passage; and a relief valve for discharging excess oil discharged from the oil pump through the oil supply passage:

a connecting path;

wherein the oil pump is positioned outside of the oil pan and is driven by the camshaft, the relief valve is positioned inside the oil pan, and the oil supply passage and the oil inlet passage are communicated with each other through the connecting path when the relief valve is opened.

2. An engine lubrication system according to claim 1 further including an oil passage formation member wherein the oil passage formation member is detachably fixed to the lower face of the engine block, and wherein the oil inlet passage, the relief valve and the connecting path are provided in the oil passage formation member.

3. An engine lubrication system according to claim 2 further including a suction pipe connected to the oil passage formation member and extending into the oil pan, wherein the suction pipe draws oil from the oil pan and supplies the oil to the oil pump.

* * * * *